US005552697A

United States Patent [19]

Chan

[11] Patent Number: 5,552,697

[45] Date of Patent: Sep. 3, 1996

[54] LOW VOLTAGE DROPOUT CIRCUIT WITH COMPENSATING CAPACITANCE CIRCUITRY

[75] Inventor: Shufan Chan, Anaheim Hills, Calif.

[73] Assignee: Linfinity Microelectronics, Garden Grove, Calif.

[21] Appl. No.: 376,028

[22] Filed: Jan. 20, 1995

[51] Int. Cl.[6] ..... G05F 1/40; G05F 1/44

[52] U.S. Cl. ..... 323/282; 323/273

[58] Field of Search ..... 323/223, 226, 323/273, 275, 280, 281, 282, 285

[56] References Cited

U.S. PATENT DOCUMENTS

| | | | |
|---|---|---|---|
| 4,543,522 | 9/1985 | Moreau | 323/303 |
| 4,779,037 | 10/1988 | Locascio | 323/275 |
| 4,837,486 | 6/1989 | Erdi | 323/315 |
| 4,851,953 | 7/1989 | O'Neill et al. | 361/101 |
| 5,220,272 | 6/1993 | Nelson | 323/282 |
| 5,373,225 | 12/1994 | Poletto et al. | 323/282 |

OTHER PUBLICATIONS

Linfinity Microelectronics, Product Data Sheet LX8385-xx, 3A Low Dropout Positive Fixed Regulator Rev. 1. Sep. 1994.

Linfinity Microelectronics, Low-Dropout Regulator Product Brochure, Rev. 2, Jan. 1995.

Linfinity Microelectronics, Production Data Sheet LX8385, 3A Low Dropout Positive Adjustable Regulator, Rev. 1. Sep. 1994.

Ahuja, Bhupendra K., An Improved Frequency Compensation Technique for CMOS Operational Amplifiers, IEEE Journal of Solid-State Circuits, vol. SC-18, No. 6, Dec. 1983.

*Primary Examiner*—Matthew V. Nguyen
*Attorney, Agent, or Firm*—Loeb & Loeb

[57] ABSTRACT

An improved low voltage dropout regulation circuit is provided. The internal compensating capacitance coupled to the regulated output port is coupled to a virtual ground and the virtual ground is current buffered for coupling to the control electrode of the path element.

21 Claims, 5 Drawing Sheets

LOW VOLTAGE DROPOUT CIRCUIT WITH COMPENSATING CAPACITANCE CIRCUITRY

BACKGROUND OF THE INVENTION

1.. Area of the Invention

This invention relates to power supply circuitry and in particular to low voltage dropout circuits.

2. Description of the Prior Art

Low voltage dropout circuits are commonly used in power supply systems to provide a regulated voltage at a predetermined multiple of a reference voltage. FIG. 1 shows a block diagram of a typical prior art low dropout voltage circuit. The circuit 10 includes an input port 12 and an output port 14, a field effect transistor 16, which is the path element, controlled by an amplifier 18. A first noninverting input to the amplifier 18 is a voltage reference 20 and the other inverting input is coupled to a node within a voltage divider 22 coupling the output port 14 to ground. Based upon the difference between a feedback voltage developed at a node 21 within the voltage divider 22 and the voltage reference 20, the amplifier 18 controls the gate voltage. The circuit 10 provides output voltage regulation independent of the output load current and the input voltage. Ignoring the voltage drop across the path element, the FET 16, the circuit 10 forces the output port voltage to be a predetermined multiple of the voltage reference 20.

To maximize the DC performance and to provide for efficient power systems, a desirable voltage regulator will have as small a drop out voltage as possible, where the dropout voltage is the voltage drop across the path element, FET 16. To achieve this low dropout voltage, it is desirable to maximize the die area of the FET transistor 16, and also to maximize the channel width to the channel length ratio of the FET 16. However, such large FET transistors have a large parasitic capacitance between the gate and the source and the drain. That parasitic capacitance will limit the upper frequency of the voltage regulator for stable operation and will permit some ripple with high frequency switching power supplies.

Another design criteria for low voltage dropout regulators is the effect of the load capacitance. In theory, the voltage regulator such as circuit 10 must be capable of driving an infinite capacitive load. Therefore, frequency compensation is necessary to keep the circuit from oscillating. To avoid such oscillations, the frequency compensation is normally done with a combination of internal and external capacitive elements. To accommodate infinite external load capacitance, the external compensation capacitor's capacitance is usually set above a minimum value. In addition, an internal compensation capacitance $C_c$ normally couples the output port 14 to the gate of the FET 16. However, due to the Miller effect from the FET 16, this capacitance and the capacitance of the FET is effectively multiplied. To maintain stability of the circuit, a dominant pole at a relatively low frequency of about less than 10 KHz is needed. To attain that large pole, the external compensation capacitance must be made extremely large.

However, using such large external capacitance generally creates additional problems. Such large capacitors are relatively expensive and occupy a large area on a circuit board.

It might be that AC analysis of the prior art embodiment 10 would show several other drawbacks. It is conceivable that the internal compensation capacitor $C_c$ provides a noninverting feed forward to the output port. Such a feed forward path might degrade stability if the external capacitive load exceeds the compensation capacitor.

Also, depending upon whether p-channel or n-channel transistors are used, either negative or positive power supply ripple may be injected into the system as a result of such feed forward non-inverting capacitance. In particular, the internal compensation capacitor $C_c$ provides a zero to either the negative or positive power supply ripple at about the lower pole of the circuit. Such ripple at the output of a voltage regulator injects noise into other circuits and should be reduced as much as possible.

Therefore, it is a first object of the invention to provide a dropout voltage regulator having a low dropout voltage and high efficiency. It is a second object of the invention to provide such a low dropout voltage regulator circuit having small external capacitance to reduce cost and the size of the entire circuitry. It is yet another object of the invention to provide a voltage regulator with good frequency stability and good high frequency power supply rejection ratio. It is still yet another object of this invention to eliminate the effects of non-inverting feed forward coupling by the compensation capacitor $C_c$. It is still yet an additional object of the invention to eliminate the zero provided by the internal compensation capacitor $C_c$.

SUMMARY OF THE INVENTION

These and other objects are obtained by a novel compensation method for a low dropout voltage regulator. The input port is coupled to the output port by a FET and the output port is coupled to ground by a voltage divider. The gate of the FET is coupled to a voltage buffer amplifier that has as an input a current summing node. The current summing node is coupled to the output of a transconductance amplifier and to an output of a current buffer. The input of the current buffer is coupled to the output port by an internal compensation capacitor $C_c$ and one input of the amplifier is coupled to the voltage reference while the other input is coupled to a node within the voltage divider. A small external compensation capacitor is also coupled across the voltage divider.

In the disclosed embodiments, the current buffer in the feedback loop provides frequency compensation. In particular, the use of the current buffer prevents direct capacitive loading of the external compensation capacitor and moves the output pole frequency towards a higher frequency than would otherwise be readily possible. With the second pole from the external capacitor shifted up in frequency, the internal dominant pole can be shifted towards a higher frequency such that the external capacitor can be set at a lower value and still permit stable operation. Further, the current buffer reduces the noninverting feed forward path through the internal coupling capacitor $C_c$. The current buffer also eliminates a zero for the ripple for one of the power supply terminals.

DETAILED DESCRIPTION OF THE INVENTION

Figure 1:
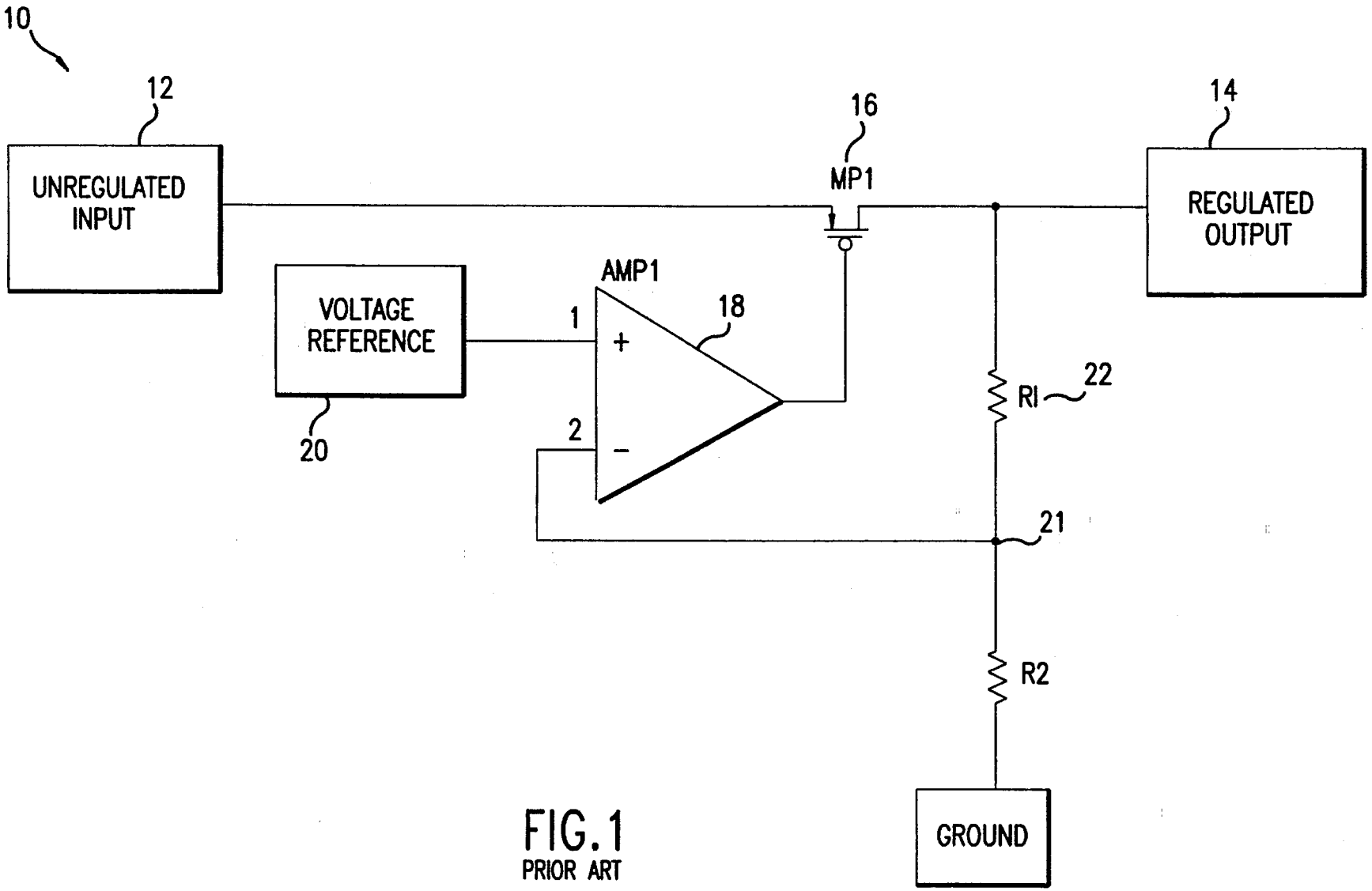
FIG. 1 PRIOR ART
FIG. 1 is a simplified block diagram of a dropout voltage regulator according to the prior art.
Figure 2:
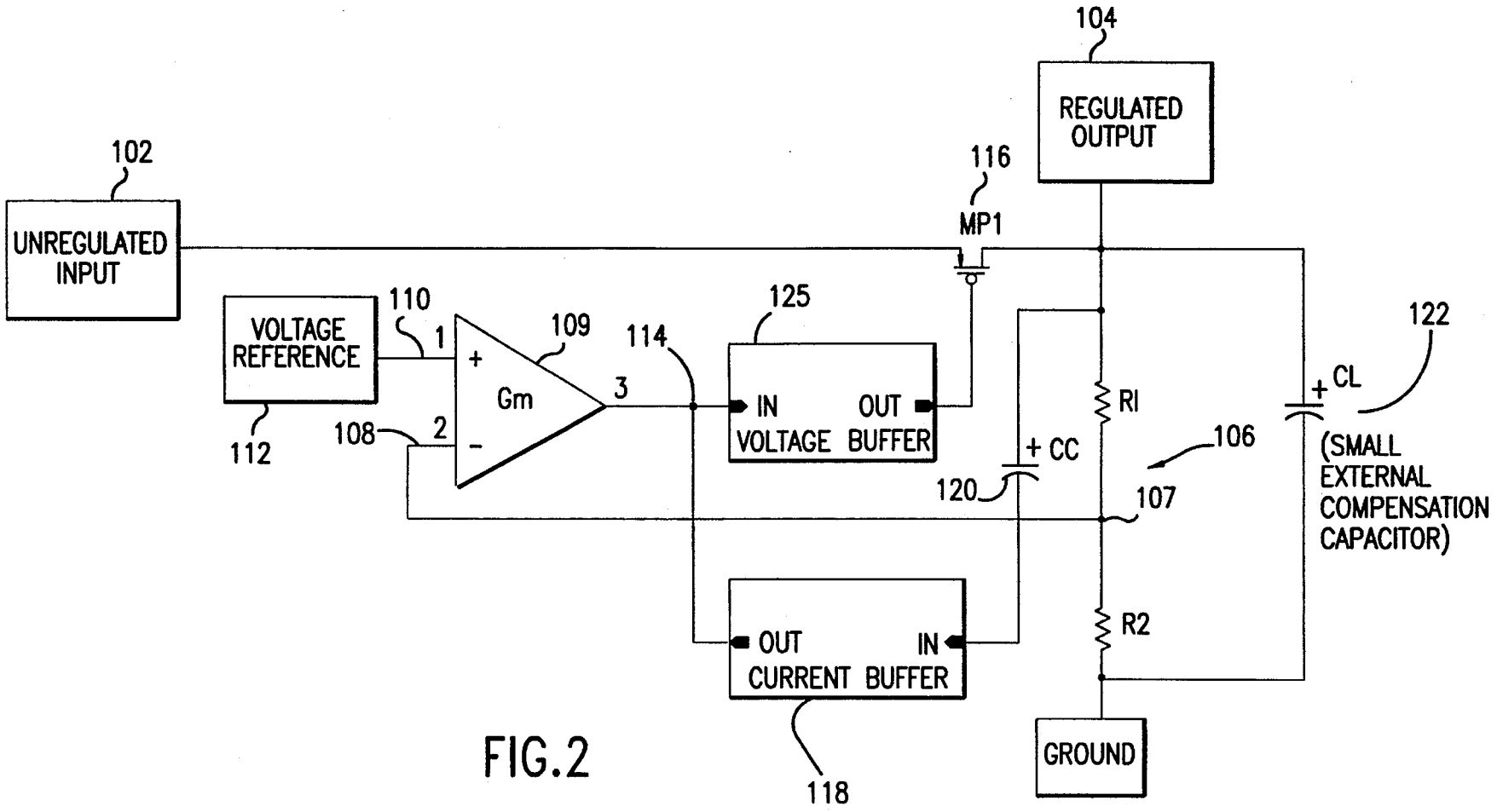
FIG. 2 is a simplified schematic diagram of a dropout voltage regulator according to an embodiment of the disclosed invention.

FIG. 2 shows a simplified block diagram of a circuit 100 incorporating an embodiment of the invention. The unregulated input voltage from, for example, a switching power supply voltage source (not shown) is applied to the input port 102. The input port 102 is coupled to the output port 104 by a path element, FET 116. The output port 104 is coupled to ground by a voltage divider 106. A node 107 within the voltage divider is coupled to the inverting input 108 of a transconductance amplifier 109. The noninverting input 110 is coupled to the reference voltage supplied by the reference voltage generator 112. The output of the amplifier 109 is coupled to a current summing node 144. The summing node is coupled by a current buffer circuit 118 to the output port 104 by an internal compensation capacitor ($C_c$) 120. The summing node is coupled to the gate of the FET 116 by a voltage buffer amplifier 125. An external capacitor 122 also couples the output port 104 to ground for stability.

The DC operation of the circuit is substantially as in the prior art. As the voltage at the output port 106 increases, the voltage at the node 107 within the voltage divider 105 rises. As a result, the output of the transconductance amplifier decreases, so the gate of the FET 116 is driven towards cutoff, thereby lowering current flow and the voltage at the output port 104. As the voltage at the output port 104 drops, the voltage at node 107 also drops, thereby providing a greater output voltage at the output of the transconductance amplifier 109. This permits the FET 116 to conduct more, thereby raising the current and the output voltage.

The AC operation of the circuit 100 is, however, substantially improved by the order of at least one order of magnitude by the use of the current buffer amplifier and the voltage buffer amplifier. In particular, the inclusion of these elements means that there is substantially no non-inverting feed forward effect at higher frequencies. In particular, an AC ground is provided within the current buffer 118 for the compensation capacitor $C_c$. This AC ground effectively eliminates the feed forward effect provided by the internal compensation capacitor $C_c$ in the prior art. By eliminating the feed forward effect, stability is improved dramatically for relatively small external compensation load capacitances. Further, the use of this circuit eliminates the zero in the circuit due to the absence of a feed forward effect to the output. As will be described in more detail below, this permits a smaller external capacitance of about 0.1 μf to be used for a circuit that can drive practically any load capacitance and still be stable throughout the frequencies of interest.

Further, the circuit also provides improved power supply rejection. In particular, the internal compensation capacitor $C_c$ no longer provides a zero for the power supply ripple, thereby improving the power supply rejection ratio of the circuitry.

Figure 3:
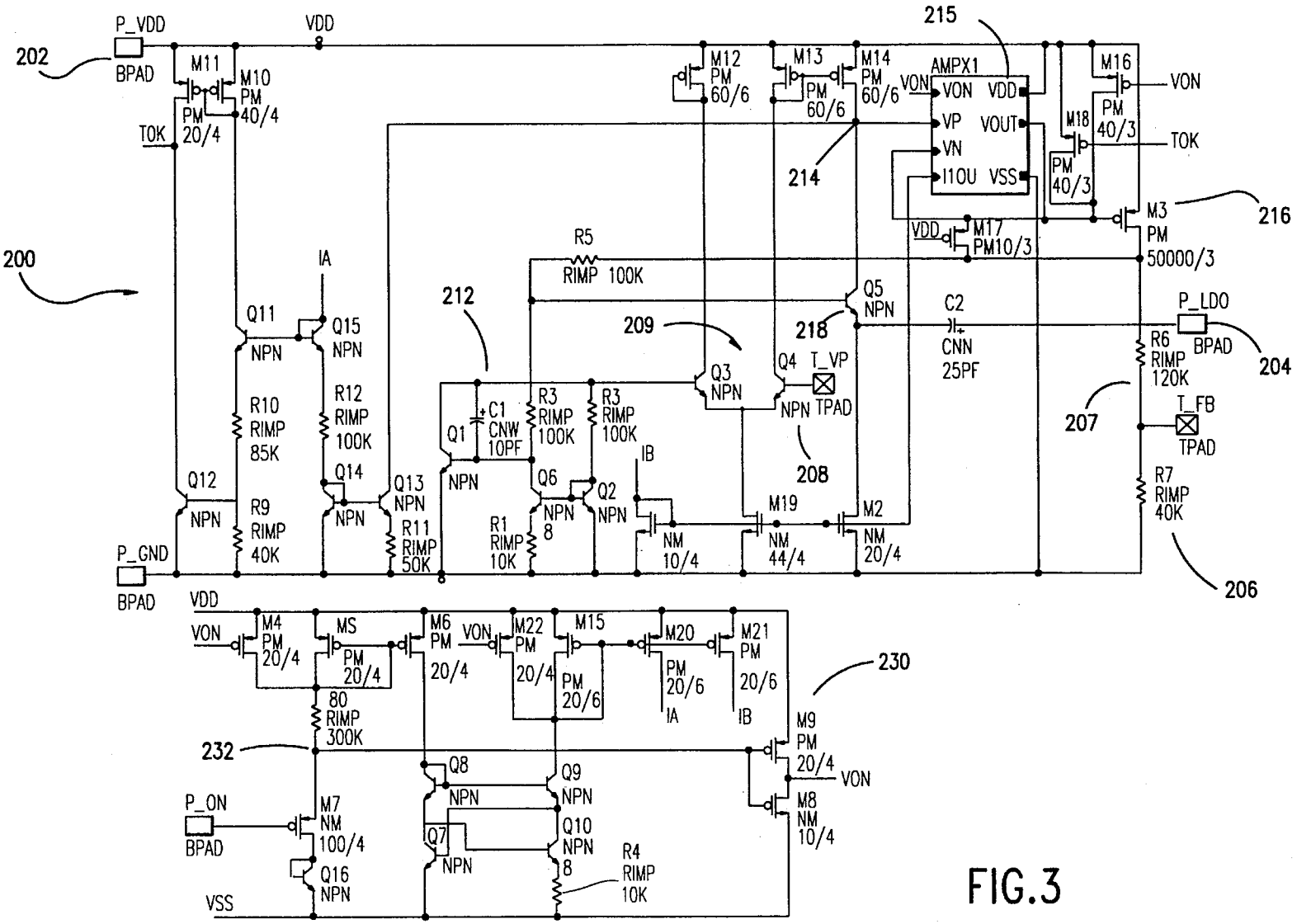
FIGS. 3 and 4 are a detailed schematic of an embodiment of the invention.
Figure 4:
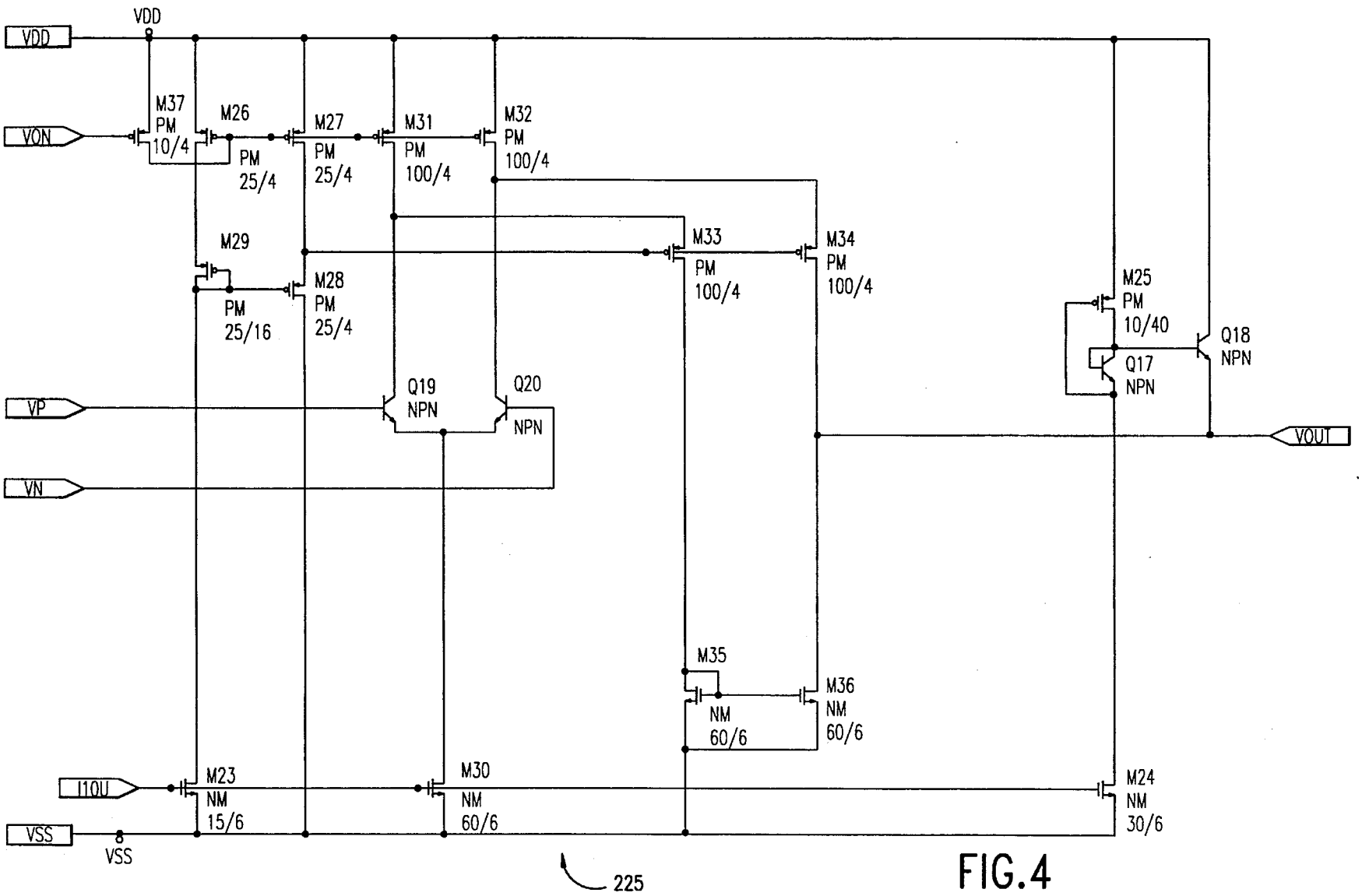

FIGS. 3 and 4 show a more detailed description of an embodiment 200 of the invention. The input voltage port 202 receives the unregulated power supply voltage and the output voltage is supplied at output port 204. Coupled between the two ports is a large area path element 216, comprised of a FET M3 having channel width to length ratio of 50000 to 3. The nodes labelled IA, IB ION, TOK, VDD and VSS are coupled to each other respectively; for example the node IA coupled to the drain of transistor M20 is coupled to the collector of transistor Q15. Capacitor C2, which is a 25 pf internal compensation capacitor ($C_c$) is coupled between the output port 204 and the current buffer 218 comprised of common base circuit including NPN transistor Q5. A voltage buffer amplifier 225 is shown in block diagram form as AMPX1 and is described in more detail in FIG. 4.

The transconductance amplifier 109 comprises the emitter coupled pair of NPN transistors Q3 and Q4. The reference voltage circuit 212 is generated by a bandgap generator circuit comprised of the components shown in TABLE 1:

| Component | Value |
|---|---|
| Transistor Ql | Minimized for Power Reduction |
| Transistor Q2 | Minimized for Power Reduction |
| Transistor 06 | Minimized for Power Reduction |
| Resistor R1 | Minimized for Power Reduction |
| Resistor R2 | 100 K |
| Resistor R3 | 100 K |
| Capacitor Cl | 10 pF |

The voltage divider 206 of FIG. 3 comprises resistors R6 and R7, which are respectively 120K and 40K ohm resistors. The inverting input 108 of the transconductance amplifier 109 comprises the node lapelled T_VP coupled to the base of transistor Q4. Feedback between the output port 204 and the buffer amplifier AMPX1 is provided by the coupling capacitor C2, which is nominally 25 pF. That feedback is coupled by an common base amplifier comprised of transistor Q5 with the current summing node 214 being coupled to the collector of transistor Q5. Another current supplied to the summing node 214 is supplied from the output of the transconductance amplifier 109 by a current mirror comprised of transistors M11 and M14. A third current is provided for purposes of temperature compensation from transistor Q13.

Thermal protection is provided by transistors M10, M11, Q12, and Q11 to generate a thermal protection signal TOK. When the amount of current being drawn through the circuit increases past the predetermined threshold, the signal TOK turns on transistor M18, thereby turning off the path element 216, FET M3. This provides a thermal shutdown effect.

Low voltage protection is also provided by circuit 230. When node 232 drops below a predetermined voltage as set by transistors M5, resistor R8, transistor M7 and diode Q16, the output of the FET inverter comprised of FETS M8 and M9 goes low, thereby turning off the current sources IA and IB. By turning off these current sources, the tail current to the transconductance amplifier 209 supplied by transistor M19, the tail current from transistor M2, and the current source for the AMPX1 circuit discussed in more detail below are turned off. In addition, the path element 216 comprised of transistor M3 is turned off by transistor M16, which is set up in a hard wire or function with transistor M18. Further, an external control signal supplied at pad P_ON permits a microprocessor or external control logic to power down the circuit to permit a low current power down mode.

The details of the buffer amplifier AMPX1 225 are shown in FIG. 4. The buffer amplifier comprises an emitter coupled differential transistor pair Q19, Q20 having an inverting input VN and a non-inverting input VP. A single ended output is provided at VOUT. VOUT is coupled in FIG. 3 to the control element (the gate) of the path transistor 216 and to the inverting input VN to provide a voltage buffer.

By isolating both the gate to source and gate to drain capacitance of the path element and the internal compensating capacitance C2 coupled between the output port and the current buffer, overall circuit performance is dramatically improved. In particular, the current sink M2 for capacitor C2 provides an AC virtual ground for the internal compensating capacitor C2. This in turn breaks the feed forward path at high frequency from the control node to the output port 204. In addition, the zero for the ripple on the $V_{DD}$ pad has been substantially eliminated.

Figure 5:
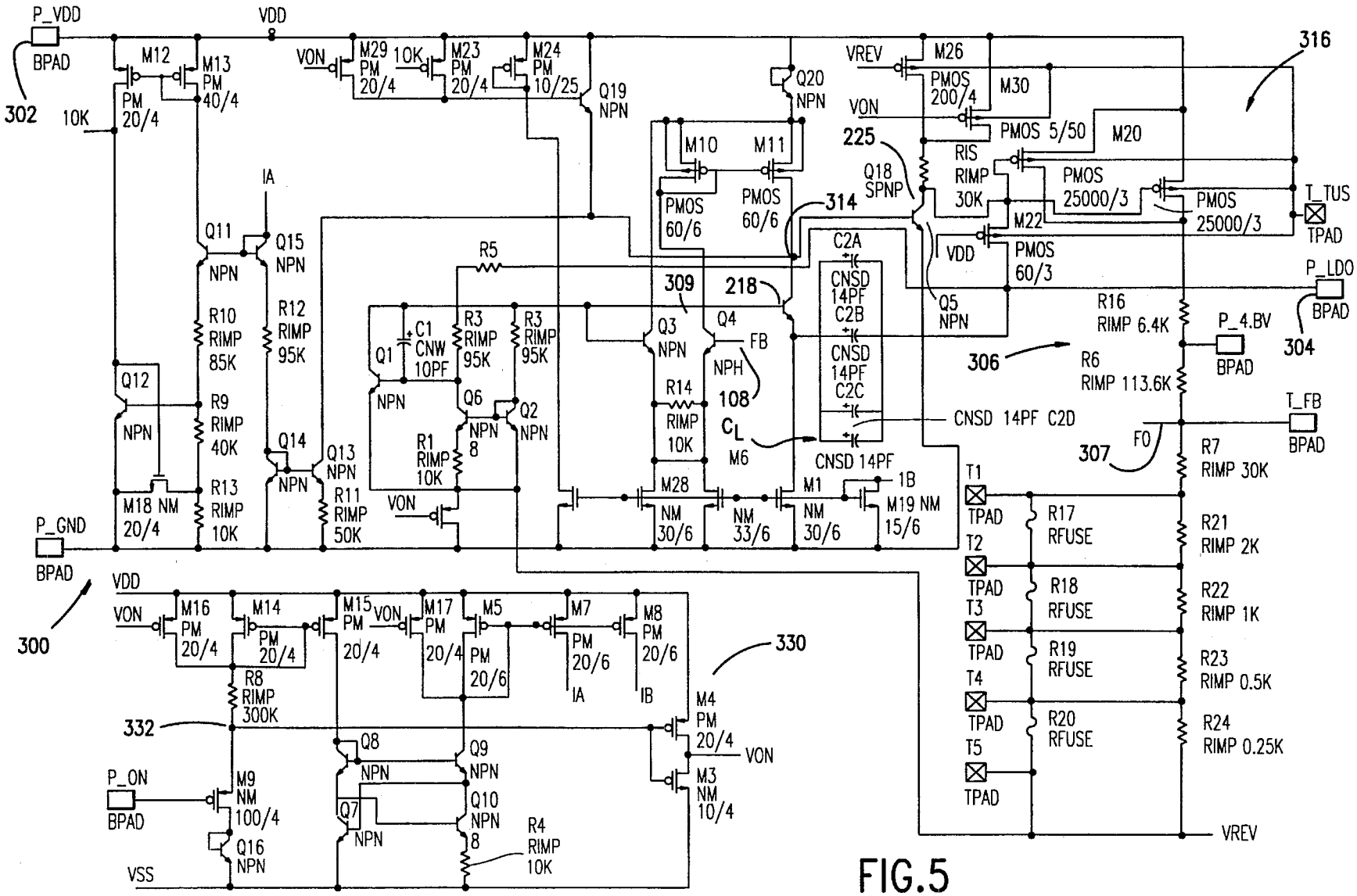
FIG. 5 is a schematic of yet another embodiment of the invention.

FIG. 5 shows an alternative circuit 300 with like components bearing like numbers. In this embodiment, the path element M3 216 of FIG. 3 has been replaced with two path elements 316, PMOS transistors M2B and M2A having channel widths of 25,000 and channel lengths of 3. The function of transistor M18 is replaced by the function of transistor M23 and the function of transistor M16 is replaced by transistors M30 and M29. Capacitor C2 is replaced by parallel capacitors C2 a having a combined capacitance of 56 pF. Amplifier AMPX1 is replaced by an emitter follower amplifier 225 comprised of transistor Q18. The voltage divider in FIG. 3 comprised of resistor R6 and R7 is replaced by a network of resistors comprised of resistors R16, R6 R7 and resistors R21 through R24. The resistance of the divider can be altered by blowing fuses R17 through R20 during wafer probe through the appropriate test pads, labelled TPAD. The feedback from the divider to the amplifier 309 is provided through the coupling of FB to the base of transistor Q4. Emitter degeneration can be added to the transconductance amplifier by blowing the link that parallels resistor R14. In addition, the bandgap generator is coupled to ground through a low impedance path during normal operation by transistor M27. When the circuit is in a power down mode or the input voltage $V_{DD}$ drops below the threshold generated in the low voltage detector 230, transistor M27 turns off, turning off the band gap generator. In this latter condition, $V_{rev}$ goes towards $V_{DD}$ thereby forcing transistor M26 high and thereby providing additional turning off of the path elements.

By such an arrangement of isolating the internal compensating capacitor $C_c$ from the gate of the path elements and the output of the transconductance amplifier, the internal poles of the circuit are shifted up by at least one order of magnitude. This permits reducing the size of the external capacitor used for providing frequency stability dramatically without increasing the dropout voltage. Calculated dropout voltages for the second of the detailed embodiments is as follows:

| Drop Out Volt. | Current Load |
|---|---|
| 0.6 V | 500 ma |
| 0.45 V | 400 ma |
| 0.3 | 300 ma |
| 0.2 | 200 ma |
| 0.1 | 100 ma |

With the disclosed circuit, the Power Supply Rejection Ratio for a 1 KHz switching power supply at 100 ma load is calculated to be greater than 70 dB. For the same current load at 100 KHz, the Power Supply Rejection Ratio is greater than 50 dB. Therefore, the disclosed embodiments provide low voltage dropout, good high frequency performance with smaller external components.

In addition, the disclosed circuit may be fabricated on an integrated circuit using standard integrated circuit techniques such as masking with photoresist, etching, implantation, passivation, oxidizing and annealing. Also given the reduction of the Miller effect, it may now be feasible to form the load capacitor on the die.

In sum, the circuit provides improved frequency stability and power supply ripple rejection with a smaller external load capacitance. To achieve these improvements, the internal compensating capacitance coupled to the control node (the gate) of the path element is coupled to a virtual ground provided by the current sink M1 in FIG. 5 or M2 in FIG. 3. Further, the virtual ground is current buffered from the output of the transconductance amplifier by a current buffer circuit such as transistor Q5 to ensure isolation of the virtual ground and to avoid the formation of a feed forward path to the output port. In addition, the control electrode is isolated by the voltage buffer such as AMPX1.

Although specific embodiments of the invention are disclosed, it would be understood by those of ordinary skill in the art that other embodiments may be used. For example, although the disclosed reference voltage generator is a band gap voltage generator other types of reference voltage generators may be used such as those involving zener diodes or other known structures capable of providing good reference voltages. Further, although both a differential amplifier and an emitter follower are shown as voltage buffer amplifiers and a common base circuit is shown as a current buffer, other types of buffer circuits well known in the field may also be used as would be readily understood by those of skill in the field. In particular, for the current buffer circuit to provide the proper isolation of the compensating capacitance $C_c$ to avoid loading and the Miller effect, a circuit block providing a high impedance to the summing node should be provided. Also those of ordinary skill would understand that the feedback voltage to be provided to the inverting input of the amplifier need not be generated by a resistive voltage divider but may be generated through other means. Still further, while shown as an internal compensating capacitance $C_c$, an external capacitance may also be used coupling the output port to the input of a current buffer amplifier to provide a compensating capacitance path. In addition, other techniques for providing a virtual ground may be used other than the specific techniques disclosed. Therefore, the scope of the invention should be determined by the claims.

I claim:

1. In a low dropout voltage regulator circuit comprising an input and an output port coupled to each other by at least one path element having a control electrode and parasitic capacitance, a reference voltage generator, a means for generating a feedback voltage dependent upon the voltage at the output port, an amplifier having an input responsive to the reference voltage generator and an input responsive to the feedback means to provide a first current based upon the difference between the feedback voltage and the reference voltage, wherein the control electrode is responsive to the output of the amplifier such that the voltage at the output port is approximately a multiple of the reference voltage and wherein the improvement comprises:

a compensating capacitor responsive to the voltage at the output port; and isolation means responsive to the capacitor for providing feedback to the control node without providing additional capacitive loading.

2. The low voltage dropout regulator of claim 1, wherein the path element has a Miller effect and the isolation means reduces the Miller effect with respect to the capacitor.

3. The low voltage dropout regulator of claim 2, wherein the output of the amplifier and the isolation means are further buffered from the control electrode of the path element by a voltage buffer amplifier.

4. The low voltage dropout circuit of claim 3, wherein the isolation means is a common base circuit and the buffer amplifier comprises a differential pair of transistors.

5. The low voltage dropout circuit of claim 3, wherein the isolation means is a current buffer comprised of a common base circuit and the buffer amplifier comprises an emitter follower amplifier.

6. A low voltage dropout regulator comprising:

an input port;

an output port;

a field effect transistor having a source coupled to the input port and a drain coupled to the output port and a gate electrode controlling current flow between the source and the drain, the field effect transistor having parasitic capacitance providing a pole of the dropout voltage regulator, wherein the gate of the transistor is controlled to provide a regulated voltage at the output port;

a bandgap voltage generator;

a differential amplifier having an output and first and second inputs, the first input being coupled to the bandgap voltage generator and the second input being responsive to the voltage at the output port;

a feedback compensating capacitor having first and second leads, the first lead being responsive to the voltage at the output port;

a current buffer having an input responsive to the second lead of the capacitor and an output; and a current summing node responsive to the output of the amplifier and the current buffer with the gate electrode being responsive to the current at the current summing node.

7. The low voltage dropout circuit of claim 6, wherein the gate electrode is coupled to the summing node by a voltage buffer amplifier.

8. The low voltage dropout circuit of claim 6, wherein the bandgap generator is coupled to a predetermined voltage by a transistor that only conducts when the voltage at the input port is above a predetermined threshold.

9. The low voltage dropout circuit of claim 8, wherein the second input to the amplifier is coupled to a node within a voltage divider coupled to the output port, the voltage divider being coupled to ground only when the voltage is above a predetermined threshold by the transistor.

10. The low voltage dropout circuit of claim 6, wherein the FET has a second source, gate electrode and drain coupled in parallel with the first source, drain and gate electrode.

11. The low voltage dropout circuit of claim 6, wherein the low voltage dropout circuit has a capacitor coupling the output port to ground.

12. A method for generating a regulated voltage source at an output port from an unregulated voltage at an input port, the method comprising:

controlling the flow of a first current between the input and the output ports with at least one path component having a parasitic capacitance providing a first pole;

generating a feedback voltage based upon the voltage at the output port;

comparing the feedback voltage with a predetermined voltage to provide a second current based upon the comparison;

generating a third current by capacitive coupling to the output port and current buffering the capacitive current; and summing the second and the third currents to provide the control of the flow of the current through the path component.

13. The method of claim 12, wherein the summed current is buffered to provide the control of the current flow through the path component.

14. The method of claim 12, wherein the method further includes halting the generation of the reference voltage generator and the feedback voltage when the voltage at the input port drops below a predetermined threshold.

15. A method for making a low voltage dropout integrated circuit, the method comprising:

forming in the integrated circuit a path element having a control electrode between an input port and an output port;

forming a feedback voltage circuit in the integrated circuit having a node coupled to the output port;

forming a reference voltage generator in the integrated circuit;

forming an amplifier in the integrated circuit for determining the difference between the voltage at the node and the reference voltage generator such that flow of current through the path element results in the voltage at the output port being about a predetermined multiple of the reference voltage; and forming a compensating capacitance path between the output port and the output of the amplifier such that a compensating capacitance is isolated to thereby avoid any feed forward circuit path.

16. An integrated circuit voltage regulator comprising:

an input port adapted to be coupled to the unregulated input voltage;

an output port providing the regulated voltage;

at least one path element having a control electrode coupling the input port to the output port;

an amplifier responsive to an internally generated reference voltage and the voltage at the output such that in the DC mode a regulated voltage is supplied at the output;

a compensating capacitance coupled to the control electrode whereby the frequency stability of the circuit in the AC mode is raised; and means coupled to the compensating capacitance for preventing the compensating capacitance forming a zero with respect to any ripple in the unregulated voltage.

17. A method for making an integrated circuit power supply, the method including:

forming input and output ports and a path element having a control electrode coupling the input to the output port;

forming an amplifier responsive to a voltage difference between a reference voltage and the voltage at the output port such that the control electrode of the path element is responsive to the output of the amplifier;

forming a virtual AC ground in the circuit; and forming a compensating capacitance coupling the virtual AC ground to the output port, whereby frequency stability of the circuit is improved.

18. A method for providing a regulated DC voltage at an output port with an unregulated voltage provided at an input port, the method comprising:

determining the difference between the regulated voltage at the output port and a known reference voltage;

controlling a path element having a variable impedance between the two ports by a control electrode responsive to the difference such that impedance of the reference element varies inversely proportional to the difference;

providing a virtual ground; and coupling a compensating capacitance between the virtual ground and the control element.

19. The method of claim 18, wherein the method further includes:

sinking or sourcing a current to the capacitance;

current buffering the capacitance from the voltage difference.

20. The method of claim 19, wherein the voltage difference and the buffered current are both voltage buffered from the control electrode.

21. The method of claim 19, wherein a signal responsive to the voltage difference and the buffered current are supplied to a current summing node.

* * * * *